US007614580B2

(12) United States Patent
Naulet et al.

(10) Patent No.: US 7,614,580 B2
(45) Date of Patent: Nov. 10, 2009

(54) REMOVABLE TRAVERSING DEVICE

(75) Inventors: Christophe Naulet, Chambery (FR); Jean-Michel Cogniaux, La Motte Servolex (FR)

(73) Assignee: Saint-Gobain Technical Fabrics Europe, Chambery (FR)

( * ) Notice: Subject to any disclaimer, the term of this patent is extended or adjusted under 35 U.S.C. 154(b) by 189 days.

(21) Appl. No.: 11/572,637

(22) PCT Filed: Jul. 7, 2005

(86) PCT No.: PCT/FR2005/050549

§ 371 (c)(1),
(2), (4) Date: Mar. 23, 2007

(87) PCT Pub. No.: WO2006/018561

PCT Pub. Date: Feb. 23, 2006

(65) Prior Publication Data

US 2008/0203214 A1 Aug. 28, 2008

(30) Foreign Application Priority Data

Jul. 27, 2004 (FR) ..... 04 51671

(51) Int. Cl.
*B65H 54/28* (2006.01)

(52) U.S. Cl. ..... 242/482.9

(58) Field of Classification Search ..... 242/476.9, 242/482.8, 483.5, 477, 481.8, 481.9, 482.4, 242/482.9
See application file for complete search history.

(56) References Cited

U.S. PATENT DOCUMENTS

| | | | |
|---|---|---|---|
| 3,817,465 | A | 6/1974 | Miller |
| 4,230,285 | A | 10/1980 | Lenk et al. |
| 4,858,838 | A | 8/1989 | Harris et al. |
| 5,048,769 | A | 9/1991 | Wirz et al. |

FOREIGN PATENT DOCUMENTS

| | | |
|---|---|---|
| DE | 31 46 264 | 7/1982 |
| DE | 89 07 318 | 9/1989 |
| EP | 0 905 076 | 3/1999 |
| EP | 1 092 666 | 4/2001 |
| FR | 2 305 375 | 10/1976 |
| WO | 95 07228 | 3/1995 |

*Primary Examiner*—John Q. Nguyen
*Assistant Examiner*—William E Dondero
(74) *Attorney, Agent, or Firm*—Oblon, Spivak, McClelland, Maier & Neustadt, L.L.P.

(57) ABSTRACT

A leasing device including at least one first part connected to a frame element of a reeler and at least one second part including a mechanism for depositing and guiding at least one thread. The first part and the second part are connected to one another such that the second part occupies a first working position, in which the thread can be deposited in the form of a reel, and a second position, in which the second part is separated from the first part, corresponding to a maintenance phase of the second part.

6 Claims, 2 Drawing Sheets

REMOVABLE TRAVERSING DEVICE

Figure 1:
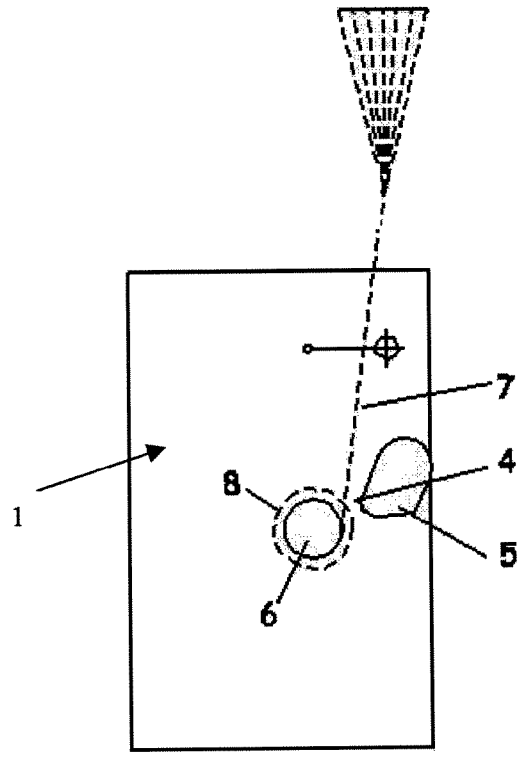

The present invention relates to an improvement to a device making it possible to effect the drawing and winding of thread consisting of organic or mineral material especially of glass.

It is aimed more particularly at an improvement to a removable leasing device.

It will be recalled that the manufacture of glass reinforcing threads is the result of a complex industrial process which involves obtaining threads from streams of molten glass flowing through spinneret orifices. These streams are drawn in the form of continuous filaments, and then these filaments are gathered together into basic threads, said threads subsequently being collected in the form of a reel.

Within the meaning of the invention, the reels take the form of packages with straight flanks or the form of cylindrical packages.

Putting into reel form is carried out with the aid of reelers which, as their name indicates, are responsible for winding at very high speed (approximately 10 to 50 meters per second) the glass threads which have previously been sized.

These reelers effect the drawing and winding of these threads, and the operating parameters of these reelers, together with those of the spinneret, govern the dimensional characteristics of the thread, especially the linear density expressed in tex (the tex being the weight in grammes of 1000 meters of fibers or threads).

Thus, to ensure a constant linear density of the thread during the entire preparation phase of the reel, in spite of the increase in diameter of the latter, the speed of the winding member of the reeler is controlled so as to ensure a constant linear winding speed of the thread, even though its angular speed varies, this speed control being carried out by reducing the rotational speed of the spindle, which supports the reel, as a function of the increase in the diameter of the latter.

Another important parameter governing the acquisition of a reel of optimum quality is the capability of the latter of being easily unwound, without the presence of loops or of unwanted knots, and with a limitation of friction.

For this purpose, it is necessary to have an optimum axial distribution of the threads reeled directly on the rotary spindle. To this end, the reeler is provided with one or more thread guides which ensure the axial distribution and the positioning of the threads along one or more reels by means of a to-and-fro movement synchronized with the rotation of the spindle, this thread guide or these thread guides forming part of a subassembly of the reeler which is generally referred to as a leasing device.

This leasing device is mounted on a movable support making it possible to reposition it permanently, during reeling, parallel to the spindle axis, so as to allow it to maintain a certain distance between the thread guide or thread guides and the outer cylindrical surface of the reel or reels, the diameter of which changes throughout its or their construction.

The known reelers consist essentially of a frame generally positioned underneath a spinneret, this frame supporting the leasing device and at least one spindle movable in rotation, this spindle being designed, on the one hand, to generate the reel and, on the other hand, to support the latter.

Conventionally, the leasing device mainly comprises at least one grooved cylindrical cam which ensures the to-and-fro function of the thread guide or thread guides, the latter being guided in translational motion between two strips parallel to the axis of the cam. The cam is driven in rotation by a motor by means of a mechanical transmission and is sprinkled permanently by spray nozzles which ensures that it is permanently clean so as to ensure no soiling due to the environment where the method is carried out.

To obtain the total winding capacity, it is necessary that the leasing device, as described above, or any other equivalent device can describe the length of the reel. For this purpose, in known reelers, the traveler is mounted movably in a to-and-fro translational movement on a shaft secured to the frame and parallel to the axis of the spindle, this second translational movement thus making it possible to cover the length of the package.

So that the reeling of the reel takes place optimally, it is necessary for the leasing device likewise to function optimally, and it is appreciated then that a maintenance phase is carried out at regular intervals in the region of the leasing device, this maintenance phase thereby entailing a production interruption, the frequency and duration of which it is, of course, desirable to limit.

The present invention is aimed, therefore, at mitigating these disadvantages by proposing a leasing device which optimizes the maintenance phases on the leasing device.

For this purpose, the leasing device according to the invention is characterized in that it comprises at least one first part connected to a frame element of a reeler and at least one second part comprising means for depositing and guiding at least one thread, said first part and second part being connected to one another in such a way in that the second part occupies a first position, referred to as the working position, in which the thread can be deposited in the form of a reel, and a second position, in which the second part is separated from the first part, corresponding to a maintenance phase of the second part, the second part being interchangeable.

By virtue of these arrangements and, especially, by virtue of the presence of a leasing device in two separable parts (separable cassette) it is possible to carry out maintenance phases virtually in covered time. The production of a cassette in two parts, one of these remaining secured to the frame and the other being demountable and interchangeable, makes it possible to form for the latter a replacement component which can quickly be replaced by a similar component, virtually without any production interruption.

In preferred embodiments of the invention, moreover, it is possible, if appropriate, to resort to one and/or other of the following arrangements:

- the first part and the second part comprise complementary guide means which allow a relative movement between the first position and the second position of the second part,
- the guide means comprise, on the one hand, at least one rail projecting in the region of the first part and, on the other hand, in the region of the second part, at least one groove designed for cooperating with said rail,
- the first and second parts comprise interlocking means designed to release the guide means when the second part of the leasing device is in the working position,
- the second part comprises at least one grooved cylindrical cam which ensures the to-and-fro function of the thread guide or thread guides, the latter being guided in translational motion between two strips parallel to the axis of the cam,
- the first part and the second part each comprise mechanical coupling means making it possible to effect the setting in movement of said cam and means for connecting a cleaning fluid of said cam and of the thread guide or thread guides, the means for connecting the cleaning fluid can be shut off when the second part of the leasing device is separated from the first part.

Figure 2:
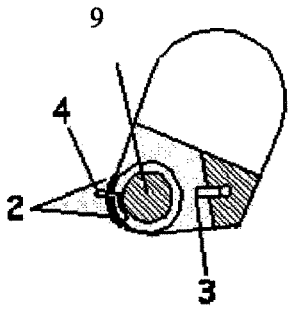
Figure 3:
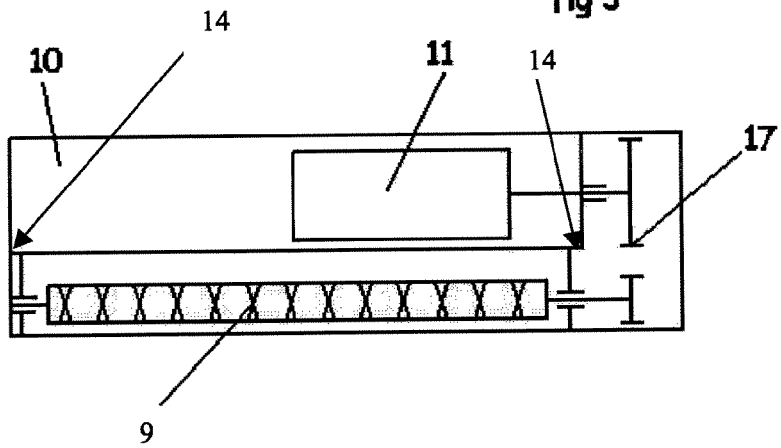
Figure 4:
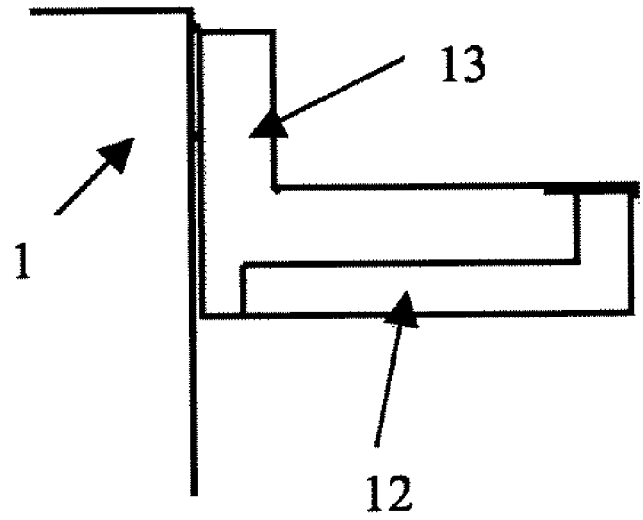
Figure 5:
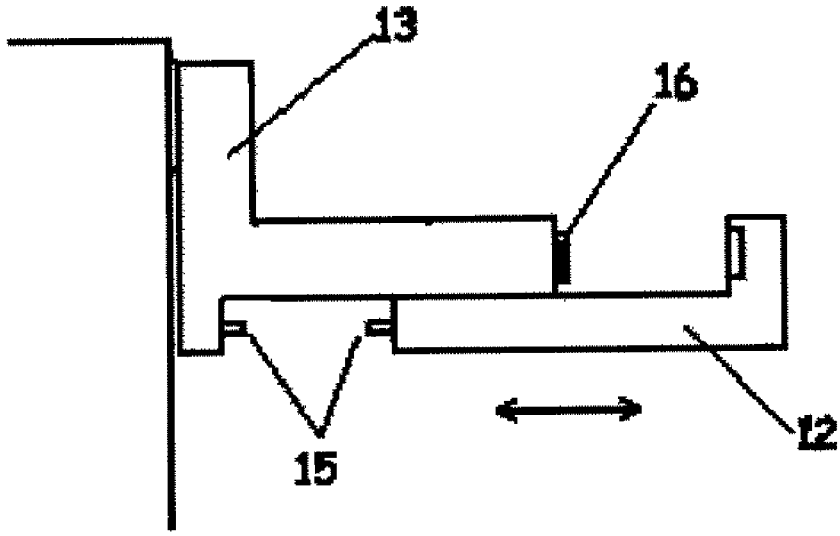

Other characteristics and advantages of the invention will become apparent from the following description of one of its embodiments which is given by way of nonlimiting example, with reference to the accompanying drawings in which:

FIG. 1 is a diagrammatic front view of a reeler incorporating a leasing device according to the invention, FIG. 2 is a front view of a leasing device according to the invention, FIG. 3 is a side view of FIG. 2, FIG. 4 is a side view of the leasing device in the working position, FIG. 5 is similar to FIG. 4, but with the leasing device in the maintenance position.

According to a preferred embodiment of the reeler 1 according to the invention, illustrated in FIG. 1, the latter comprises a metallic frame obtained by means of a technique involving the mechanical welding of metallic elements previously machined or available as standard in the trade. This frame comprises essentially a substantially rectangular base resting on feet carefully placed so as to correspond to the gage or to the spacing of the forks of a pallet truck or of a similar handling device, in order to make it easier to install this reeler in a drawing position.

On this base is assembled a closed structure which is intended to receive all the components necessary for the functioning of the reeler 1. In this respect, and in a nonlimiting way, this closed structure, taking the form of a cabinet, is provided with control and command devices necessary for the control of the various members which will be described later in the present description (hydraulic, electrical and compressed-air networks and networks for other fluids necessary for the functioning of said members).

The closed structure has cooperating on it a barrel which is mounted movably in rotation about an axis of rotation and is held within one of the walls of the closed structure by means of a rotary guide member (ball bearing ring).

To be precise, this barrel forms an assembly for supporting a spindle 6. In FIG. 1, it can be seen that the barrel comprises a spindle 6 (it will be conceivable to have a barrel possessing a plurality of spindles in diametrically opposite positions or a barrel comprising at least three, four or even more spindles, depending on the available overall size and the capacities of the spinnerets positioned upstream). Within the reeler, the barrel makes it possible to transfer a spindle 6 previously unloaded and provided with at least one empty tube (within the meaning of the invention, a tube is a support which consists, for example, of plastic or of cardboard and is intended for receiving the thread reel 8) into a reeling position and simultaneously to transfer another spindle having full tubes toward an unloading position by means of 180° rotations, of course if the barrel comprises two spindles.

The spindle 6 secured to the barrel forms a rotary assembly designed for reeling the thread onto a tube previously introduced on a spindle 6. This reeling takes place along a first axis of rotation substantially parallel to the axis of rotation of the barrel.

In FIG. 1, another element which is essential for the production of the package is evident. This is a device for positioning and guiding the thread on the spindle or referred to more generally as a "leasing device" 5.

In this example, illustrated in detail in FIGS. 2 and 3, this leasing device 5 comprises at least one groove cylindrical cam 9 which ensures the to-and-fro function of the thread guide or thread guides 4, the latter being guided in translational motion between two strips 2 parallel to the axis of the cam 9. The cam 9 is driven in rotation by a motor 11 by means of a mechanical transmission 17 and is sprinkled permanently by spray nozzles 3 which ensures that it is cleaned.

In a variant illustrated in the figures, there may be a traveler movable within a slot, the traveler being displaced linearly along a second axis substantially parallel to the axis of rotation of the spindle 6.

Whatever the embodiment, the leasing device 5 can approach or retreat from the outer peripheral surface of the reel during the reeling of the latter, especially as a result of rotation about an axis of articulation, this axis of articulation serving as a connection point between the frame of the reeler and the leasing device.

FIGS. 4 and 5 illustrate diagrammatically the leasing device 5 according to the invention. The latter is in two parts (a first 13 and a second 12), these two parts 12, 13 cooperating with one another by means of guide means of complementary shape. In the example illustrated, the guide means are produced in the form of at least one rail in the region of the first part 13 of the leasing device 5 and slide within at least one groove made in the region of the second part 12 of the leasing device.

It will easily be understood that the type of guide means between the first and the second part of the leasing device may be reversed, and it is possible even to envisage other types of equivalent guide means between these two parts, so that the second part can have a relative movement with respect to the first part of the leasing device. In this example, this is a translational movement which makes it possible to desecure the second part from the first part.

In FIG. 4, the two parts are secured to one another and the leasing device is in the working position which, in fact, corresponds to a phase of the winding of at least one thread on the peripheral surface of a reel. Within the meaning of the invention, in the working position, the guide means are "released". In this position, the guide means have no bearing, and the two parts of the leasing device rest at their end by means of interlocking surfaces which form bearing surfaces via which the forces are transferred.

In FIG. 5, the two parts slide with respect to one another, the leasing device being in the demounting phase for the purpose of changing it or maintaining it. In this position, the guide means are active and support the weight of the second part during the entire demounting phase (relative movement between the two parts of the leasing device).

This maintenance phase may relate particularly to the thread guides 4 which undergo rapid wear, the spray nozzles 3 which may happen to become blocked, the transmission members 16, 17 which may be damaged, and the cam 9 and its windings which may become soiled or worn in spite of washing, and, more rarely, the motor 11 which may break down.

The second part 12 of the leasing device forms an interchangeable removable cassette which, if appropriate, is different from one product application to another.

To make the mounting and demounting operations easier, moreover, this cassette has a total weight lower than the limit set by the regulations in force relating to the carrying of a load by an operator, and it is freed from the water connection 15 and from the coupling 16 for the mechanical transmission of the rotational movement of the motor by means of an automatic junction effected, on the one hand, by an automatic connector capable of being shut off against water and, on the other hand, by a direct clutch-type engagement system for the mechanical junction.

The invention, as is described above, affords many advantages:

It makes it possible to reduce the time involved in maintenance on the leasing subassembly, by making it very easily interchangeable, to one man, without the need to move the reeler from its production position, and by means of simple tools.

The invention claimed is:

1. A leasing device configured to approach or retreat from an outer surface of a thread reel, comprising:

at least one first part connected to a frame element of a reeler;

at least one second part comprising a device for depositing and guiding at least one thread, the first part and second part being connected to one another such that the second part occupies a first working position, in which the thread can be deposited in a form of a reel, and a second position, in which the second part is separated from the first part, corresponding to a maintenance phase of the second part, the second part being interchangeable; and wherein the leasing device further comprises a cleaning fluid spray device and the first and second parts each comprises a mating water connector to allow fluid to flow through the water connectors between the first and second parts when the first and second parts are in the first working position.

2. The leasing device as claimed in claim 1, wherein the first part and the second part comprise complementary guide means for allowing a relative movement between the first position and the second position of the second part.

3. The leasing device as claimed in claim 2, wherein the guide means comprises at least one rail projecting in the region of the first part and, in the region of the second part, at least one groove configured to cooperate with the rail.

4. The leasing device as claimed in claim 2, wherein the first and second parts comprise interlocking means for releasing the guide means when the second part of the leasing device is in the working position.

5. The leasing device as claimed in claim 1, wherein the second part comprises at least one grooved cylindrical cam to allow to-and-fro function of at least one thread guide, the at least one thread guide being guided in translational motion between two strips parallel to the axis of the cam.

6. The leasing device as claimed in claim 1, wherein the mating water connectors prevent fluid from flowing between the first and second parts when the first and second parts are in the second position.

* * * * *